United States Patent [19]

Lamm

[11] Patent Number: 4,978,558

[45] Date of Patent: Dec. 18, 1990

[54] METHOD FOR APPLYING DIFFUSION COATING MASKS

[75] Inventor: Foster P. Lamm, South Windsor, Conn.

[73] Assignee: United Technologies Corporation, Hartford, Conn.

[21] Appl. No.: 204,815

[22] Filed: Jun. 10, 1988

[51] Int. Cl.[5] ..... C23C 16/00

[52] U.S. Cl. ..... 427/250; 264/328.18; 427/252; 427/253; 427/259; 427/272; 427/282

[58] Field of Search ..... 427/250, 252, 253, 259, 427/272, 282; 264/328.18

[56] References Cited

U.S. PATENT DOCUMENTS

| | | | |
|---|---|---|---|
| 3,202,543 | 8/1965 | Thun et al. | 427/259 |
| 3,764,371 | 10/1973 | Baldi | 427/252 |
| 3,785,854 | 1/1974 | Baldi | 427/253 |
| 3,801,357 | 4/1974 | Baldi | 427/252 |
| 3,904,789 | 9/1975 | Speirs et al. | 427/253 |
| 4,128,522 | 12/1978 | Elam | 260/32.8 R |
| 4,181,758 | 1/1980 | Elam | 427/253 |
| 4,467,016 | 8/1984 | Baldi | 427/253 |
| 4,568,244 | 2/1986 | Wehnert et al. | 416/134 A |
| 4,591,400 | 5/1986 | Fradenburgh et al. | 156/80 |
| 4,617,202 | 10/1986 | Baldi | 427/253 |
| 4,687,796 | 8/1987 | Cordova et al. | 523/466 |
| 4,695,509 | 9/1987 | Cordova et al. | 428/267 |
| 4,725,650 | 2/1988 | Landi et al. | 525/138 |
| 4,728,573 | 3/1988 | Temple | 428/378 |
| 4,737,540 | 4/1988 | Yoshida et al. | 524/537 |
| 4,845,139 | 7/1989 | Baldi | 427/253 |

FOREIGN PATENT DOCUMENTS

| | | | |
|---|---|---|---|
| 55-154139 | 12/1980 | Japan | 264/328.18 |
| 57-178732 | 11/1982 | Japan | 264/328.18 |

OTHER PUBLICATIONS

Fred W. Billmeyer, Jr., "Textbook of Polymer Science", p. 498.

*Primary Examiner*—Norman Morgenstern
*Assistant Examiner*—Sadie Childs
*Attorney, Agent, or Firm*—James M. Rashid

[57] ABSTRACT

Methods for selectively applying a diffusion aluminide coating to the surface of a metal article while keeping other article surfaces free of the coating are described. The method includes the steps of injection molding a mixture of materials onto the surfaces which are to be kept free of coating; the material comprises solid particles effective in preventing deposition of the coating onto the surfaces and a moldable amorphous thermoplastic resin; it contains no volatilizable solvents. The mixture is applied to the article surface to a thickness of about 5 millimeters. It is useful in pack diffusion as well as vapor phase diffusion aluminide coating operations.

7 Claims, 1 Drawing Sheet

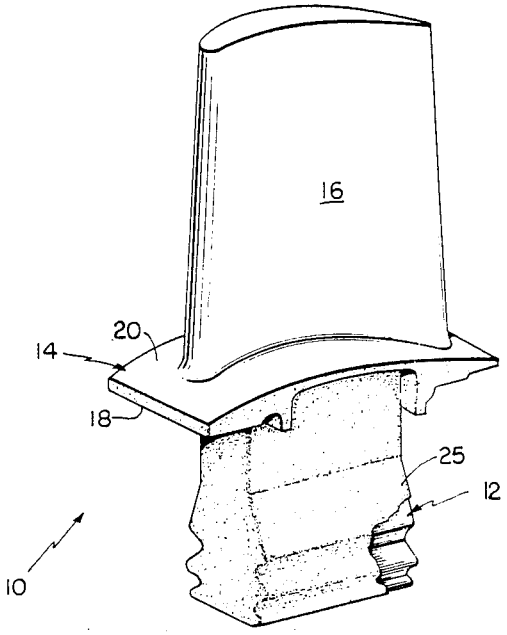
16
20
14
18
25
12
10

METHOD FOR APPLYING DIFFUSION COATING MASKS

This invention was made with United States Government support under a contract awarded by the Department of the Air Force. The Government has certain rights in this invention.

TECHNICAL FIELD

This invention relates to diffusion coatings, and in particular to diffusion aluminide coatings More specifically, the invention relates to a method for applying a coating mask to surfaces of a metal substrate prior to a diffusion aluminide coating process.

BACKGROUND

The blades and vanes which are commonly used in the turbine section of modern gas turbine engines are typically made of nickel and cobalt based superalloys. The composition of the superalloys are generally tailored to provide a desirable combination of mechanical strength and resistance to environmental degradation (e.g., oxidation and hot corrosion). Coatings are often used to increase the level of oxidation and hot corrosion resistance, to allow the components made from such superalloys to be used for long periods of time before they need to be replaced or repaired.

Such protective coatings are typically of two different types overlay coatings and diffusion coatings. Representative of the overlay coatings are the MCrAlY family of coatings, as described in U.S. Pat. Nos. 3,928,026 to Hecht et al and U.S Pat. No. Re. 32,121 to Gupta et al. Overlay coatings are applied by physical vapor deposition techniques such as plasma spraying or electron beam evaporation techniques. Representative of the diffusion coatings are the aluminide coatings described in U.S. Pat. Nos. 3,544,348 to Boone et al and 4,132,816 to Benden et al.

In some circumstances, coatings are applied to only certain surfaces of the engine component. In the case of a turbine blade, it is sometimes necessary to keep the root portion of the blade free of coating. To accomplish such selective coating application, masks are used to protect or shield such surfaces Masks used in the diffusion coating industry are described in, for example, U.S. Pat. Nos. 3,764,371, 3,785,854, 3,801,357, to Baldi; 3,904,789 to Speirs et al; and 4,128,522 to Elam; the contents of each of these patents are incorporated by reference. While such types of masks are generally considered to be useful, their application is a time-consuming and labor intensive process. Accordingly, improvements in diffusion coating masks and their method of application are desired, and in particular, a mask which is quickly and easily applied is needed for the diffusion coating industry.

SUMMARY OF THE INVENTION

According to this invention, a mask which prevents a diffusion coating from depositing onto surfaces of a metal component during a diffusion coating process is applied to the component surfaces by injection molding a masking mixture containing a volatilizable resin and solid particles onto the component prior to the diffusion coating process. The injection moldable masking mixture preferably contains about 13–20 weight percent thermoplastic resin and about 80–87 weight percent solids. The most preferred solids constituents in the mask are nickel particles and aluminum oxide particles, while the most preferred constituents in the thermoplastic resin are polystyrene and polypropylene.

The invention is particularly suited for applying a mask onto the root portion of a gas turbine engine blade prior to a pack aluminide coating process. It is equally useful for applying a mask onto other blade surfaces, as well as onto the surfaces of gas turbine engine vanes. Accordingly, the terms "blade surfaces" are meant to mean the surfaces of blades, vanes, and other similar components. Various other aspects of this invention will be apparent from the following description and drawings.

BRIEF DESCRIPTION OF THE DRAWING

The FIGURE is a perspective view of a blade used in a modern gas turbine engine, coated with a mask according to this invention.

BEST MODE FOR CARRYING OUT THE INVENTION

Referring to the FIGURE, a blade 10 used in the turbine section of a gas turbine engine comprises a root section 12, a platform 14 and an airfoil section 16. The platform 14 has a radially inwardly facing surface 18 and a radially outwardly facing surface 20. The blade is made of any of the known superalloys used in the turbine section of modern gas turbine engines. See, for example, U.S. Pat. No. 4,205,348 to Duhl et al.

The invention is used in conjunction with the application of a diffusion coating to the airfoil portion 16 and the radially outwardly facing portion 20 of the platform 14; the root portion 12 and the radially inwardly facing underside portion 18 of the platform 14 are desirably kept free of coating Such selective application of the diffusion coating is accomplished by applying a mask 25 to the blade root and platform surfaces prior to the diffusion coating process, in the manner set forth below.

According to this invention, the mask 25 contains a solids portion and a resin portion, the combination thereof comprising a masking mixture. The masking mixture is applied to the root 12 and inwardly facing platform surface 18 in a conventional type of injection molding process. During the injection molding process, granules or pellets of the masking mixture are heated and homogenized in a suitable mixing chamber until they reach a fluid-like state; the mixture is then injected, under pressure, into a mold having a cavity which surrounds the portions of the blade to be masked. The masking mixture solidifies in the mold and bonds to the blade surface.

Various constituents may comprise the solids portion of the masking mixture. For example, the solids portion can contain materials of the type described by Elam in U.S. Pat. No. 4,128,522, namely titanium oxide, nickel powder, and alumina Other useful solids portion constituents are simply nickel powder and alumina, as described by Baldi in U.S. Pat. No. 3,764,371, as well as cobalt powder and nickel aluminide powder as described by Baldi in U.S. Pat. No. 3,801,357. Solids constituents other than the ones specifically mentioned above may also be used, and are considered to be within the scope of this invention, as long as they are effective in preventing deposition of the diffusion coating onto the component surface. Regardless of the specific materials which comprise the solids portion, such materials must not detrimentally react with the blade or interfere with the deposition of the coating onto the surfaces of the blade which are desired to be coated. While the solids constituents are referred to as particles in this description of the invention, other forms of particulate material are included and within the scope of the invention.

The resin portion of the masking mixture is present to render the solids portion injection moldable; the resin portion does not appear to perform any function during the coating process, with respect to preventing deposition of the coating onto the masked surfaces, other than to hold the solids portion onto these surfaces. The resin portion should not detrimentally react with the blade during the coating process; organic resins which are readily volatilized are preferred, with the additional requirement that if the resins leave any residue behind after volatilization, the residue should not react with the blade or interfere with the coating deposition process. Thermoplastic resins are the most preferred class of resins used in this invention.

The particular resins used should be resistant to excessive shrinkage, and should have good toughness, i.e., should be crack resistant. Any of the various types of engineering thermoplastics that tend to be amorphous will have good shrink resistance, since they in general will not undergo a phase transformation and volume change when cooled after injection molding. Examples of useful amorphous thermoplastics are the polystyrenes, polyetherimides, polyolefins and polyesters. An example of a thermoplastic with desirable crack resistance is polyethylene. The preferred resin used in this invention is a mixture of polystyrene and polyethylene. Polystyrene undergoes very little volumetric expansion when cooled after injection molding at a rate equal to or greater than air cool, and therefore the cooling rate of mask must approximate or exceed air cool rates.

The amount of resin present in the masking mixture of this invention is in the range of about 10–25 percent, by weight. A more preferred range is about 13–20 percent by weight. The most preferred amount of resin in the mixture is about 15 weight percent. In other words, on a weight percent basis, the ratio of the solids portion to the resin portion ranges from about 9:1 (for mixtures containing 90% solids and 10% resin) to about 3:1 (for mixtures containing 75% solids and 25% resin); the more preferred ratio is from about 6.7:1 to about 5:1 (for mixtures containing 13–20% resin); the most preferred ratio is about 5.7:1 (for mixtures containing 15% resin). Such relatively high ratios of solids to resin is unusual for composite injection molded products (i.e., products which contain a reinforcing phase dispersed within a resin-type matrix). Conventional injection molded products contain considerably smaller amounts of solids constituents; accordingly, the solids to resin ratio in prior art structures is less than the ratio in the invention mixture. Typically, the ratio of solids to resin in conventional injection molded products is about 1:1, or less See, for example, U.S. Pat. No. 4,728,573 to Temple and 4,695,509 to Cordova et al.

The masking mixture and the method for applying it according to this invention have several advantages compared to the techniques currently used in industry. The advantages are primarily related to the absence of organic based solvents in the invention mixture. As indicated in the aforementioned patent to Elam, prior art masking mixtures contain about 15% by volume of such types of solvents. The solvents act as a carrier which allow the prior art mixtures to be brushed onto the blade surfaces in a manual operation. Resins are also present in the mixture so that when the solvents volatilize, the solid constituents are bonded to the blade surface. However, the presence of solvents in prior art masks significantly limits the shelf life and working period of the masking material, because once the solvent begins to volatilize, the mixture becomes more difficult to apply. Also, the solvent causes storage problems (for example, problems relating to fire safety) as well as problems relating to waste disposal. The masking mixture of this invention contains no volatilizable solvents and therefore has a nearly infinite shelf life, and no storage or disposal problems. Because of the extended shelf life of the invention masking mixture, unused portions of the mixture (i.e., portions remaining in the mixing chamber after the molding cycle) can readily be reheated and molded in a subsequent molding cycle. Also related to the absence of volatilizable solvents in the invention masking mixture is that the solidified mask is typically free from shrinkage cracks and other similar defects which tend to be present in prior art masks. Such cracks are formed in prior art masks as the solvent evaporates. The injection molding techniques of this invention for applying the mixture to the surfaces to be masked lends itself to high volume output since the mask is applied in a single step, as opposed to the multiple applications required of the prior art materials, (prior applications are required to achieve the requisite mask thickness). Also, the invention technique lends itself to automation, and requires minimal human effort and skill.

The following example serves to illustrate this invention, but is not to be construed as limiting the scope of the invention. A masking mixture containing about 85 weight percent solids portion and about 15 weight percent resin binder was prepared. (On a volume percent basis, the mixture contained 55 percent solids and 45 percent resin.) The solids constituents were about 60 percent nickel powder particles and about 40 weight percent aluminide oxide powder particles. The nickel powder was predominantly −325 mesh, as was the alumina. The resin constituents were about 13 weight percent polystyrene and about 2 weight percent polypropylene. The solids and resin constituents were mixed using conventional injection molding technology and formed into pellets which were then added to a screw type injection molding press. A nickel base superalloy blade was fixtured in a mold having a cavity which corresponded to the shape of the blade root. The masking mixture was heated in the injection molding apparatus to a temperature of about 260° C. and then injected into the cavity at a rate of about 10 cubic centimeters per second. The mask was allowed to cool in air, after which the blade was removed from the cavity; visual inspection indicated that all of the blade root surface and the inwardly facing surface of the platform were uniformly coated with the maskant. No cracks or other defects were visually apparent on the surface of the mask. The typical thickness of the mask was about 5 millimeters (mm). The blade was then processed in an aluminide coating operation of the type described in the above mentioned patent to Boone et al.

During the Boone process, the part to be coated was disposed in a powder mixture which was heated to an elevated temperature. The heated powder mixture produced aluminum rich vapors which diffused into the unmasked surfaces of the blade to form the aluminide coating. The invention mask interfered with diffusion of such vapors into the component surface by acting as a barrier, shielding the masked surfaces from the vapors. Metallographic examination revealed that aluminum had diffused partly into the mask, but that the mask was applied to a thickness sufficient to prevent aluminum from diffusing entirely therethrough and into the surface of the blade. Based upon the kinetics of conventional aluminiding processes, the mask should be applied to a thickness of at least about 3 mm; the maximum mask thickness should be no greater than about 10 mm.

Although this invention has been described in conjunction with a preferred embodiment, it should be understood that modifications and variations may be made without departing from the spirit and scope of the invention. For example, the as-applied mask is useful in a pack diffusion process as well as a gas phase diffusion process. Also, the mask can be applied by transfer molding techniques as well as injection molding techniques. The useful ratio of solids portion to resin portion will be dependent upon the particular constituents in each portion. As an example, the levels of nickel powder and alumina can range from about 50–70% and 30–50% by weight respectively, and the levels of polystyrene and polypropylene from 12–14% and 1–3% respectively. In such relative amounts, between about 80–87% of the mixture is solids and about 13–20% resin.

While injection molding is the preferred technique for applying the masking mixture onto the blade surfaces, transfer molding may also be used. The term "injection molding" is meant to encompass both techniques.

I claim:

1. A method for applying a metal coating onto the surface of a metal substrate comprising the step of injection molding a masking mixture onto a portion of said surface, wherein the masking mixture is characterized by no volatilizable solvents and comprises solid particles effective in preventing deposition of the coating onto the substrate surface an a moldable amorphous thermoplastic resin, and then diffusing the coating onto the unmasked portion of the substrate.

2. The method of claim 1, wherein said masking mixture consists essentially of, by weight, about 80–87% solid particles and about 13–20% resin.

3. The method of claim 2, wherein the solid particles are, by weight, about 50–70% nickel and 30–50% aluminum oxide, and wherein the resin consists essentially of, by weight, about 12–14% polystyrene and 1–3% polypropylene.

4. The method of claim 3, wherein the solid particles are about 60% nickel and 40% aluminum oxide, and the resin consists essentially of about 13% polystyrene and 2% polypropylene.

5. A method for applying a diffusion aluminide coating onto the surface of a gas turbine engine blade while at the same time preventing the application of said coating onto other surfaces of the blade, comprising the step of applying a masking mixture onto said other surfaces by injecting molding a mixture characterized by no volatilizable solvents and which comprises solid particles effective in preventing deposition of the coating on said other surfaces and a moldable amorphous thermoplastic resin, and then cooling the masking mixture at a rate equal to or greater than air cool; diffusing aluminum into said unmasked blade surfaces by pack diffusion or gas phase diffusion; removing the blade from said source of aluminum and cooling; and then removing the mask from the masked blade surfaces.

6. The method of claim 5, wherein the solid particles in the masking mixture are, by weight, about 50–70% nickel and 30–50% aluminum oxide, and wherein the resin in the mixture consists essentially of, by weight, about 12–14% polystyrene and 1–3% polypropylene.

7. The method of claim 6, wherein the solid particles in the masking mixture are about 60% nickel and about 40% aluminum oxide, and the resin in the mixture consists essentially of about 13% polystyrene and about 2% polypropylene.

* * * * *